United States Patent [19]

Schultz

[11] 3,981,119

[45] Sept. 21, 1976

[54] METHOD OF MAKING A PRESSURE OPERATED CONTAINER FOR DISPENSING VISCOUS PRODUCTS

[76] Inventor: Robert S. Schultz, 7 Heusted Drive, Old Greenwich, Conn. 06870

[22] Filed: Sept. 9, 1975

[21] Appl. No.: 611,814

Related U.S. Application Data

[63] Continuation-in-part of Ser. No. 435,472, Jan. 22, 1974, abandoned, which is a continuation-in-part of Ser. No. 290,977, Sept. 21, 1972, Pat. No. 3,827,607, which is a continuation-in-part of Ser. No. 175,253, Aug. 26, 1971.

[52] U.S. Cl. ..... 53/37; 53/36; 141/3

[51] Int. Cl.[2] ..... B65B 31/00

[58] Field of Search ..... 53/22 R, 36, 37, 88, 53/43, 319, 320; 141/3, 20; 222/389

[56] References Cited

UNITED STATES PATENTS 3,022,923 2/1962 Hoffman ..... 222/389 X 3,224,158 12/1965 Baumann ..... 53/22 R

*Primary Examiner*—Robert L. Spruill

*Attorney, Agent, or Firm*—Hopgood, Calimafde, Kalil, Blaustein & Lieberman

[57] ABSTRACT

The invention contemplates a method of making a pressurized container for viscous foods or other viscous products in which the body of the piston has a substantially smaller diameter than the diameter of the container. The outer periphery of the piston is provided with a resilient flange member that maintains a light sealing pressure on the interior surfaces of the container, allowing the piston to move smoothly upwardly within the container. The inventive method provides enhanced assurance against product leakage and against propellant-contamination of product, prior to selective product discharge as desired.

6 Claims, 13 Drawing Figures

METHOD OF MAKING A PRESSURE OPERATED CONTAINER FOR DISPENSING VISCOUS PRODUCTS

This application is a continuation-in-part of my copending application Ser. No. 435,472, filed Jan. 22, 1974, now abandoned, which copending application is a continuation-in-part of my application Ser. No. 290,977, filed Sept. 21, 1972 (now U.S. Pat. No. 3,827,607), which application Ser. No. 290,977 is a continuation-in-part of my now-abandoned parent application Ser. No. 175,253, filed Aug. 26, 1971.

The present invention relates to method aspects of a pressure packaging system for viscous products, whereby the system is characterized by improved operation.

It is an object of the invention to provide smoother discharge flow, more precisely controlled valve action, and inherently greater capacity in a given size container of the character indicated.

A specific object is to achieve the foregoing objects in a valved pressure container having a piston operable therein in which the viscous product is in the valved end of the container and ahead of the piston while a gas, such as nitrogen, is introduced under pressure behind the piston to urge the latter against the product and expel the product through the valved opening.

Another specific object is to provide in such a container a piston and seal construction which permits the piston to operate smoothly within the container in spite of any piston expansion, as may be caused by piston absorption of oils present in the viscous product to be dispensed.

A further specific object is to provide an improved method of making such a container whereby viscous product may be loaded through the bottom of the container and in direct void-free relation with the valve.

A general object is to achieve the foregoing objects with a method which inherently simplifies container assembly, which enables smooth and reliable operation, and which also ensures (a) against product-seepage past the piston and (b) against propellant-contamination of product.

Other objects and various further features of novelty and invention will be pointed out or will occur to those skilled in the art from a reading of the following specification, in conjunction with the accompanying drawings. In said drawings.

Figure 1:
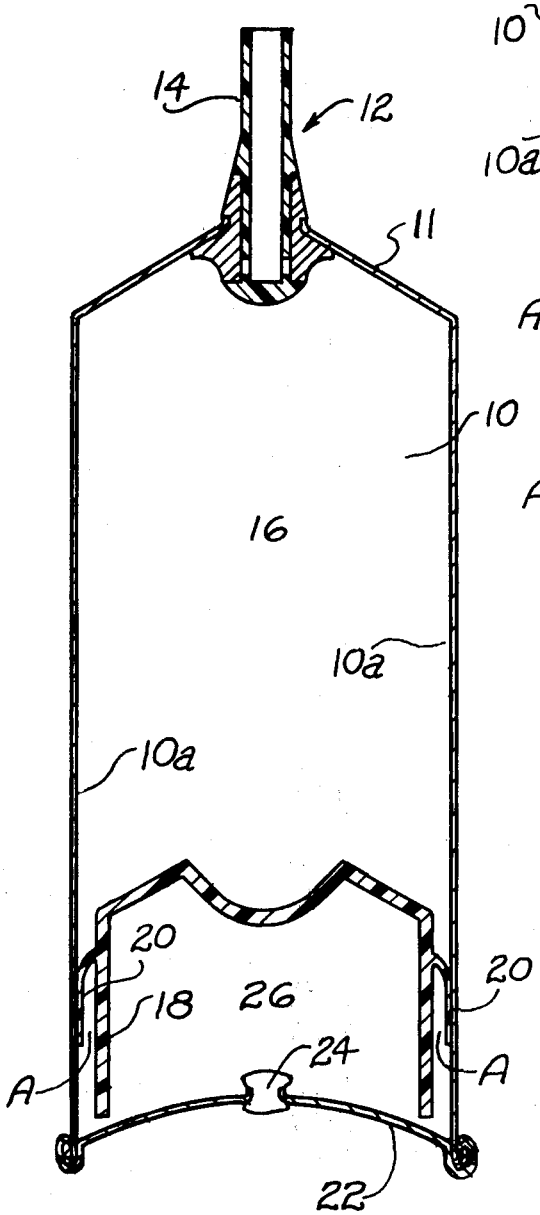
FIG. 1 is a longitudinal sectional view of a pressurized container of the invention.
Figure 4:
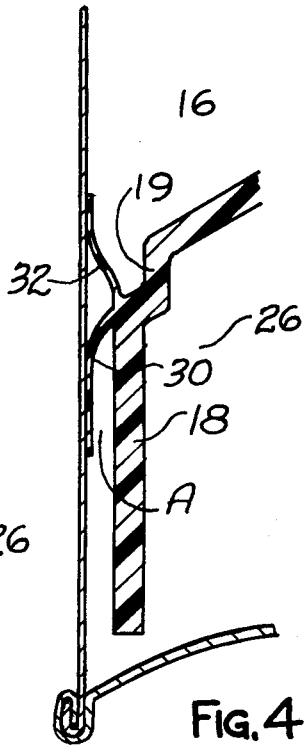
Figures 3A, 3B:
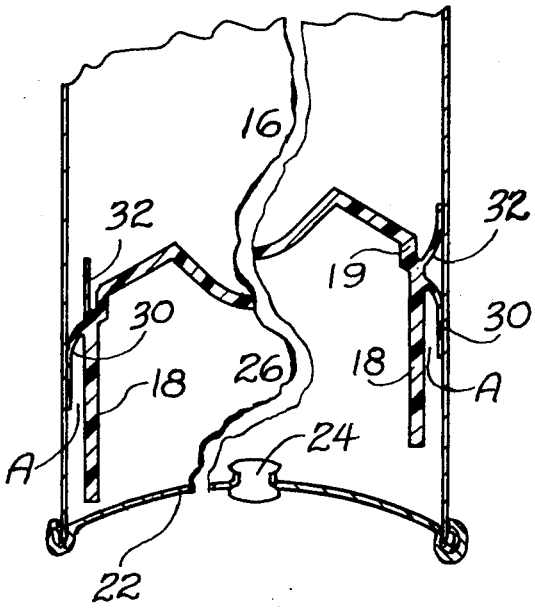
Figure 5:
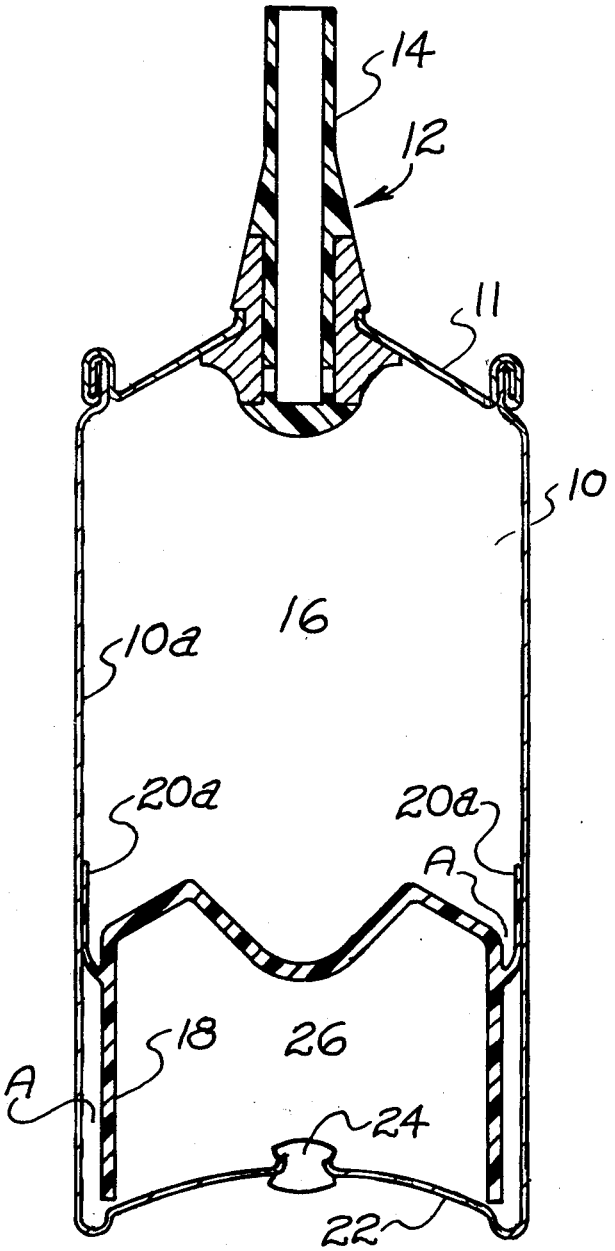
Figure 6:
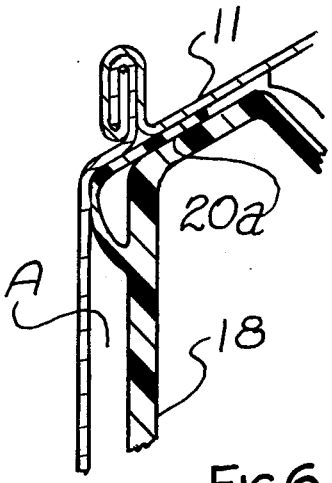
Figure 7:
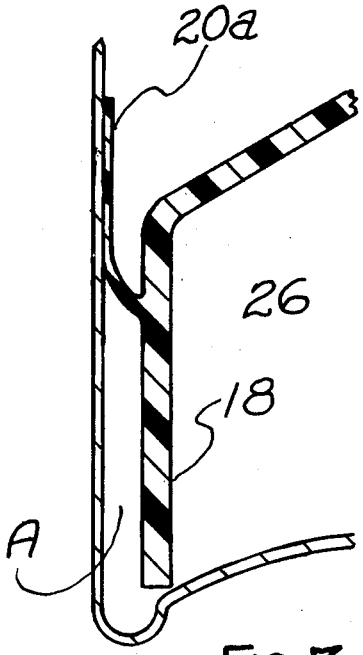
Figure 8:
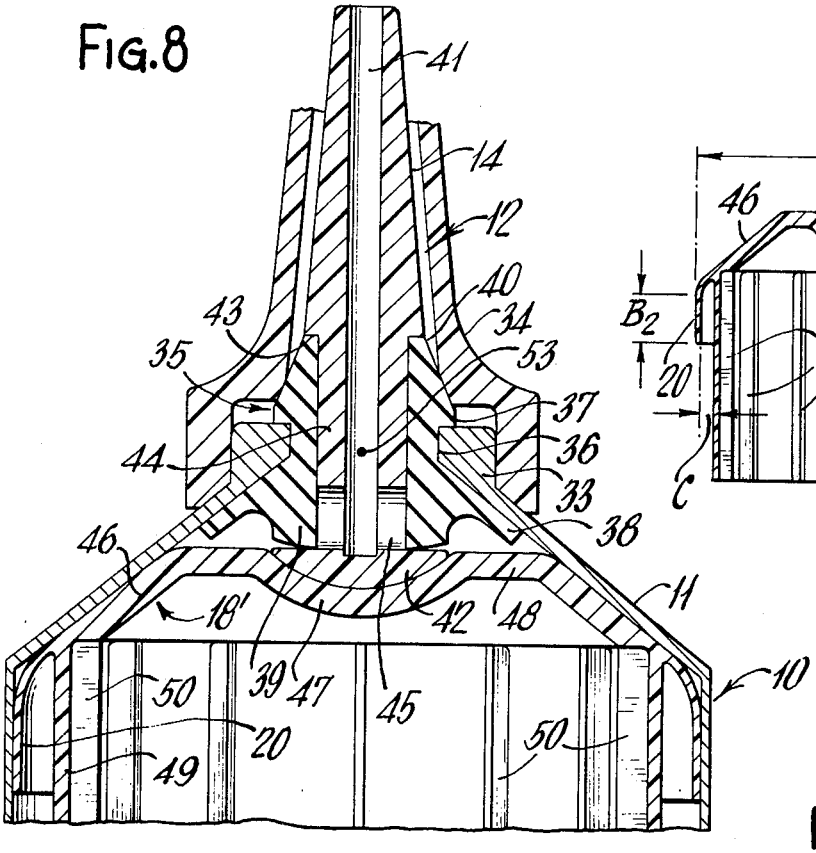
Figure 11:
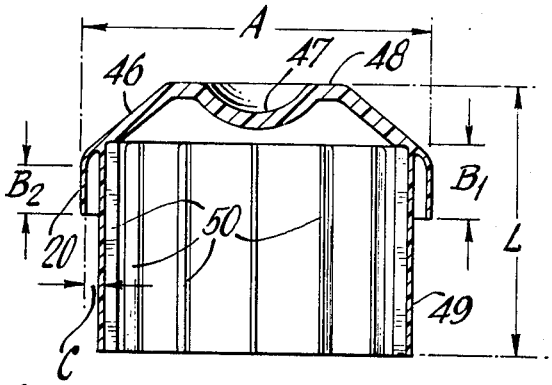
Figure 9:
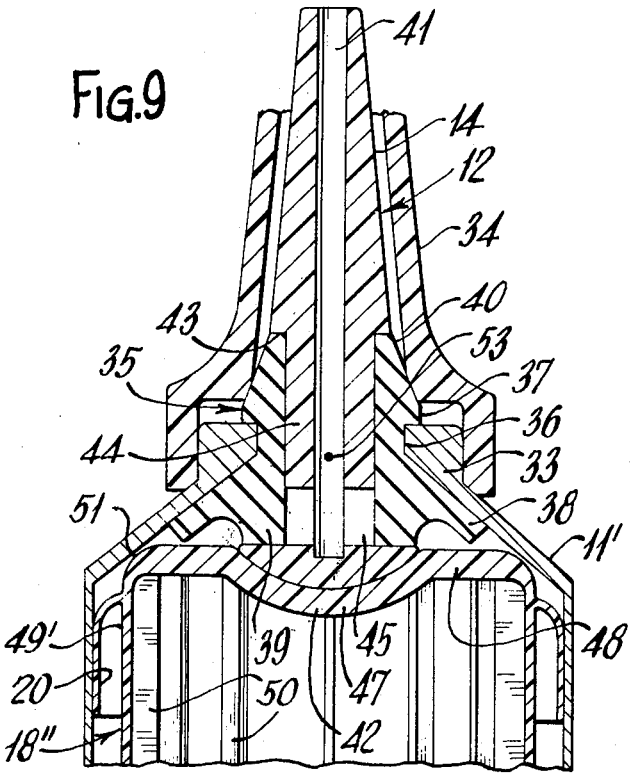
Figure 10:
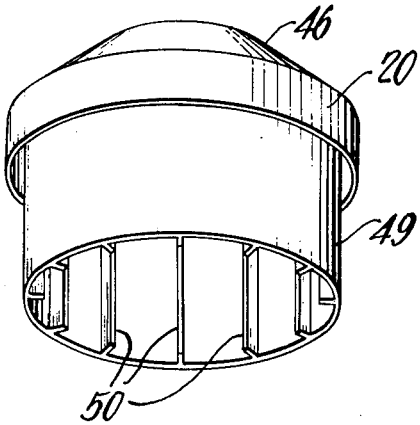
Figure 12:
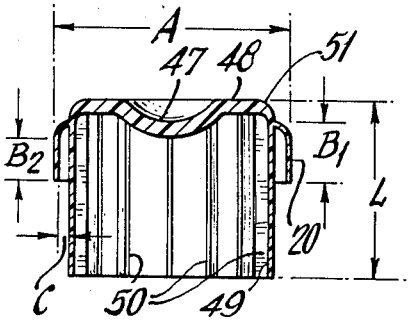

FIGS. 3*a* and 3*b* are fragmentary sectional views to illustrate another modification and showing a double-acting piston in the container in both the unloaded (FIG. 3*a*) and loaded (FIG. 3*b*) condition thereof;

FIG. 4 is an enlarged fragmentary sectional view of a portion of FIG. 3;

FIG. 5 is a view similar to FIG. 1 to illustrate a further embodiment of the invention;

FIGS. 6 and 7 are enlarged fragmentary sectional views of two different parts relationships for the structure of FIG. 5;

FIGS. 8 and 9 are similar enlarged fragmentary sectional views of the FIG. 1 combination, to show detail of the relation of parts for the uppermost position of the piston, in application to larger (FIG. 8) and smaller (FIG. 9) container bore sizes;

FIGS. 10 and 11 are respectively perspective and longitudinal sectional views of the piston in FIG. 8; and FIG. 12 is a view similar to FIG. 11, but for the piston of FIG. 9.

Referring to FIG. 1, a pressurized container or can 10 is formed with an integral conical top-end wall and provided with a valve, referred to generally by the reference numeral 12. The valve 12 is of the variety in which a valve stem 14 is pressed laterally in a well-known manner in order to release the valve seal and permit the viscous product 16, which is at super-atmospheric pressure, to be expelled to the atmosphere. A generally tubular hollow piston 18, which may be constituted of a low density polyethylene or a polypropylene material, is used to drive product 16 through the dispensing valve 12. Secured to or integral with the piston 18 is a relatively thin annular-shaped flange 20 provided with a depending skirt portion. In fact, the thickness of the flange 20 is less than half the thickness of the wall of tubular piston 18. In this regard, the thickness of the flange 20 is in the order of 0.005 to 0.015 inches. Moreover, the flange 20 is provided with a large surface area for dependable but light sealing contact with the inner wall 10*a* of the container 10.

The container 10 is closed by a bottom wall 22 having a central opening having a sealing grommet 24 through which a gas 26, such as nitrogen, is introduced after the viscous product 16 and the piston 18 are inserted into the container. The gas 26 presses against the interior surfaces of the top of piston 18 as well as in the space A, beneath flange 20 and between the outer vertical walls of the piston and the inner wall 10*a* of the container 10. It will be apparent that the pressure of the gas 26 present in the space A will force the thin resilient flange 20 into light sealing contact with the inner wall 10*a* of the container 10.

Figure 2:
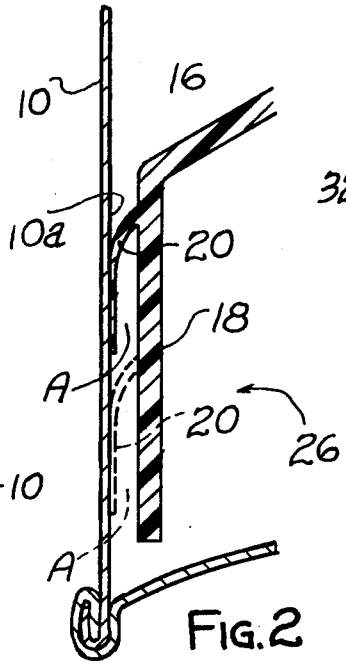
FIG. 2 is an enlarged fragmentary sectional view of the piston and adjacent container wall of FIG. 1, and further illustrating a modification.

The flange 20 may be separately secured or may be integral with the vertical wall of the piston 18 at various selected locations on the vertical wall of the piston; such a modified location of flange 20 is suggested by dashed outline in FIG. 2.

It will be noted that the space A, which permits the easy loading and operation of piston 18 in container 10, functions to provide room for the lateral expansion of the piston 18 especially when oily-type or flavored products are loaded in the container, and the piston expands due to the absorption of oils from the product. In that event, the resilient flange 20 is even further flattened against the inner wall 10*a* of the container 10; however, the light sealing pressure created by the resilient flange continues to seal the propellant from the product, but permits the piston 18 and associated structure to move smoothly in the container 10.

FIGS. 3 and 4 show an alternate type of piston 28 which is double-acting. This piston is provided with a thin resilient, annular flange 30 provided with a depending skirt portion, as already described in connection with FIGS. 1 and 2, as well as an additional annular flange 32 provided with a depending skirt portion, which is seen, in the left-hand fragmentary view of FIG. 3*a* in the unloaded state of the container 10, to be vertically self-supporting. The loaded condition of the piston 18 in the container 10 is depicted in the right-hand fragmentary view of FIG. 3*b*. Thus, when the loaded condition occurs, pressure of the product on the flange 32 of the upwardly moving piston 28 causes the flange to bend backwardly against the inner wall 10*a* of the container 10. Consequently, the piston structure shown in FIGS. 3 and 4 results in an arrangement which double-seals the piston flanges against the container wall. Moreover, the vertical body wall of the piston 18 is provided with a reduced portion 19 at the top thereof which permits substantially all of the product present to be dispensed through the valve 12.

The nature of the thin resilient flanges 20,30,32 is to flex in and out of any indentations and over any projections or other imperfections that might be present on the interior wall surfaces of the pressurized container.

FIGS. 5 to 7 show another modification of the present invention in which like parts bear the same reference numerals applied to the structure shown in FIGS. 1 and 2. In this embodiment, the container 10 is the type which is loaded with the product from the top of the container since the bottom and sides of the container are integral. As seen in FIG. 5, the entire top unit with a valve assembly is inserted on the cylindrical can after the product is loaded through the top of the can. It will be noted that the upwardly projecting thin annular flange 20*a* provided with a depending skirt portion is normally in a position adjacent to the inner wall surface 10*a* which may include an actual light engagement of this wall surface by the flange. Thereafter, the product 16 to be dispensed forces the upwardly projecting thin annular flange 20*a* against the inner wall surface 10*a* of the container 10. In this manner, a tight seal is achieved between the piston 18 and the product 16 to be dispensed. The propellant gas 26 present within the hollow piston 18 moves the latter upwardly when the valve 12 is opened. Thus, as seen in FIG. 7, when the piston 18 reaches the end of its travel upwardly against the conical top part 11 of the container 10, the flange 20*a* bends laterally to engage the undersurface of the conical top part 11, and substantially all of the product in the container 10 is expelled therefrom. It will be understood that the same result is achieved for the bottom-loaded configuration of FIG. 3 by eliminating the lower annular flange 30 from the FIG. 3 construction, and thereby relying on only the additional annular flange 32 formed integral with the piston 18.

FIG. 8 provides illustrative detail for the FIG. 1 organization applied to containers of medium or relatively large diameter. The conical end wall 11 is tapered, as in the range of 35° to 55° and, preferably, at approximately $\pi/4$ radian to the container axis, terminating at a neck bead or shoulder 33 at the central opening. Shoulder 33 serves to frictionally retain the skirt of a removal nozzle-protecting closure cap 34, as will be understood. An elastomeric grommet-like fitting or bushing 35 is locked to the reduced central end of wall 11, and the dispensing stem 14 of the valve is, in turn, locked to the fitting 35. More specifically, the fitting 35 is held at a reduced circumferentially continuous groove or waist 36, between an upper shoulder portion 37 and a lower conical flange portion 38, the latter including a substantial downwardly and outwardly projecting region that is relatively free of back-up connection to the central or main generally cylindrical body portion 39. To facilitate longitudinal assembly of fitting 35 via the interior of the container, the shoulder 37 is upwardly tapered to a reduced nose-end diameter at 40, well within the diameter of the opening of wall 11, the taper angle being less with respect to the central axis of the container than the slope angle of the conical end wall 11.

To complete the description of valve structure, the stem 14 has a central product-dispensing passage 41 which terminates at, but does not extend through, an enlarged integral head 42. Head 43 and a shoulder 43 define longitudinal limits of a reduced cylindrical body 44 which is retained by the bore of fitting 35, and one or more radial passages 45 open the lower end of passage 41 within the bore of fitting 35 and adjacent head 42. Preferably, the lower exposed surface of head 42 is spherical, as shown, about a center which approximates the instantaneous center 53 of tilt displacement of stem 14.

The closed end of the body of piston 18′ (FIG. 8) is characterized by a conical portion 46 conforming in slope to the taper of wall 11. A spherically dished central portion 47 conforms to the exposed contour of head 42, and a flat radial annulus 48 integrally unites the portions 46–47, in close proximity to the lower limit of flange 38. FIGS. 10 and 11 provide further detail, revealing the cylindrical body of the piston as a relatively thin peripheral shell or skirt 49, integrally reinforced at regular angular spacings by thin elongate and radially inward stiffening ribs 50. The juncture of the still thinner suspension and seal flange 20 may be continuous with the cone which characterizes the outer surface of portion 46, as shown.

The arrangement of FIGS. 9 and 12 illustrates how precisely the same dispensing valve and its supporting structure may be made to serve containers of smaller diameter. For this reason, the same reference numbers are used, where applicable. However, in view of the smaller container diameter, the conical upper end wall 11′ is similarly limited, to the extent that flange 38 extends so near the lower (outer) end of wall 11′ that it is impractical to form a conical portion in the closed end of piston 18′′. The end-wall portions 46–48 are thus directly connected at a rounded corner 51 to the relatively thin cylindrical skirt 49′, backed by ribs 50.

In the carring out of my invention, the axial extent of the waist 37 of fitting 35 preferably exceeds, as by 0.020 to 0.030 inch, the corresponding axial extent of the bore of the can opening in which it is retained, and the unstressed conical angle of flange 38 preferably slightly exceeds, as by 5°, the conical slope of end wall 11; thus, for a wall 11 of 45° slope from the container axis, the unstressed slope of flange 38 is preferably substantially 50°. This relationship will be understood to facilitate assembly of a stem 14 and its fitting 35 to the wall 11, while assuring resiliently loaded, peripherally continuous contour-adapting fit of flange 35 to adjacent lapped areas of wall 11.

Several important advantages will be seen to flow from the described cone-to-cone fit at 38-11, quite aside from the assembly feature just noted. For example, valve operation is more easily controlled, and the precision of valve actuation is enhanced. In operation, the fitting 35 serves as a resilient pivotal suspension, stem 14 being tilted about an instantaneous center (suggested by point 53 in FIGS. 8 and 9) within the waist region 36. Initial tilting movement is not stiffly opposed, since the root end of flange 38 is in slight clearance relation with the wall 11 near the central opening thereof; furthermore, flange 39 can be said to have a somewhat tangential connection to body 39 (in the sense about the instantaneous pivot center 53) so that flange 38 is either locally pulled down or pushed outward along wall 11, in the course of its sliding adaptation to the magnitude of tilt actuation. Stated in other words, for normal desired extents of valve-stem tilt, there is no substantial shear-force development between body 39 and flange 38. Additionally, the employment of a small-diameter container (e.g., a 1 inch diameter container, as in FIG. 9), or of a larger-diameter container (e.g., a 1.5 inch or larger diameter container, as in FIG. 8), both with conically tapered end walls 11 (11',) means greater facility for index-finger actuation of stem 14 while grasping the container body with the remaining fingers of the same hand. Still further, the use of a conical end wall (11) inherently provides more extensive area, within a given limiting container diameter, to accomplish extensive resilient overlap of a seal flange, such as the flange 38 of fitting 35.

As to the piston 18 (18'–18''), the employment of a conical tapering portion (for the larger sizes), and the use of the particular spherical-surface relationship described in connection with 42,47,53, means less axial draft in the formation of the piston end wall, while achieving a contour which can assuredly expel virtually all the viscous product. The seal skirt or flange 20 is initially of preferably slightly less diameter (e.g., 0.002 to 0.005 inch) than the container bore and has a length $B_1$ in the order of one third the piston length L (FIGS. 11 and 12), the axial extent $B_2$ of the portion in contact with the container wall being in the order of one quarter of the length L. The clearance C between flange 20 and the piston body shell 49 is in the order of 0.040 inch, for the 1 inch and 1.5 inch sizes thus far mentioned, wherein the ratio of overall piston length L to overall piston diameter D is less than unity, being preferably approximately 3:4; stated in other words, the radial offset of the tubular flange 20 from the body structure or shell 49 is in the order of 5 to 15 percent of the outer radius of flange 20, being preferably no greater than substantially ten percent of this outer radius. In these circumstances, the piston advances with uniform ease and smoothness, even though it may have cause to tilt or slightly misalign, in the course of its travel. The lower end of the piston body shell (40) always provides a limit to the possible tilt, and throughout the range of tilt angles, the seal flange 20 maintains a smoothly continuous circumferential seal between the gas-pressure region 26 and the viscous-contents region 16. Also, the spherical conformity of the convex and concave surfaces 42–47 and their relation to the instantaneous center 53 for stem (14) tilt will be seen as assuring no interference with smooth control of tilt of stem 14 (with related smooth control of discharged product flow) upon approach to final discharge of the container, and regardless of whether or not piston 18' (18'') may have been slightly tilted in the course of such approach.

Quite aside from the foregoing considerations, the bottom-fill embodiments of the invention (FIGS. 1 to 4, and 8 to 12) present the advantage that the viscous product may be more accurately metered in its loading into the container. For example, in filling an inverted can 10 of FIG. 8 (i.e., with the valve 12 and wall 11 at the bottom, and with the unclosed base end facing upwards), the viscous product may be loaded to the extent of label-proclaimed weight, plus a safety margin in the order of 1/10 to 1/8 oz., for a 6 oz. container. The piston is then inserted, the container bottom 22 sealingly affixed, and the region 26 pressure-loaded. The piston and valve are found to reliably dispense the full label-proclaimed weight, all with a product wastage (i.e., undispensable weight) of no more than substantially 1/8 oz. This is to be compared to current top-loaded practices wherein the necessary product wastage allowance is at least several times what my invention permits.

Recalling that the preferred structure is such as to provide slight clearance between the unstressed periphery of the flexible tubular flange 20 and the inner wall of the container 10, it will be appreciated that this clearance affords an air-escape for substantially void-free assembly of the piston in a bottom-fill application. In such case, of course, the bottom-filled introduction of product necessarily means void-free application of product to all inwardly exposed surfaces and contours of the valve 12 (i.e., head 42, and adjacent portion 38 of bushing 35), the container end 11, and a major contiguous extent of the cylindrical wall of container wall of container 10; subsequent application of the piston allows free or relatively free air escape until the piston head is fully conformed to and supported by the product. The bottom end 22 of the container is then secured and seal plug 24 applied after the requisite pressurizing charge of air or other gas is introduced; and this pressurizing step preferably occurs relatively soon after such piston assembly (e.g., immediately after, in a production-filling operation). By thus promptly applying pressure, the tubular flange 20 is automatically pressure loaded into extensive-area light, sealing contact with the container wall, thus assuring against product leakage into the pressurized-gas region 26. Also, in the event that freon or other gas-producing liquid is relied upon for propellant purposes in region 26, the mere development of gas pressure is found to be adequate to assure against leakage of such propellant liquid into contaminating contact with the product. Product quality, dischargeable product volume, and gas pressure are thus found to be maintainable for substantially increased shelf life of the filled package, as compared with prior constructions and methods.

Quite aside from and in addition to the foregoing, it will be noted that by reason of equilibrium between hydrostatic pressure in the product region and gas pressure in the pressure region 26, in conjunction with the convergent resilient conical annulus (e.g., at 38–39, in bushing 35) between the conical end wall 11 and the valve stem 44, a residual pressure loading is automatically established in the upward direction and over the inwardly exposed effective area at 38,39,42, resulting in a strong axially upward wedging force on bushing 35, such that substantially continuous and highly effective seal action exists as between bushing 35 and container end 11, and between bushing 35 and stem 44. This strong and effective seal action is achieved as long as valve 12 is closed and as long as product remains to be dispensed, and regardless of the fractional extent to which product may have been dispensed; such seal action is a direct result of the indicated geometry of structural relation and of the indicated method steps which result in pressure-loading of the product., It will be appreciated that the invention is applicable to the dispensing of various products, representing a relatively wide range of different viscosities, and that the more viscous the product the more it is likely to be characterized by an uneven upper surface upon bottom-filling discharge into the inverted open-bottom container body 10; generally, the center of the product filling is characterized by an upwardly projecting profile. In such case, I have found it highly effective to impart a fractional rotation of the inserted piston about its axis (and coaxial with the container axis) in the course of applying the piston to the upper surface of the product. Such fractional rotation (for example, one quarter to three quarters of a revolution) drags piston-contacted product so as to quickly fill all valleys in the product-to-piston surface relationship, thus assuring void-free piston-contact with the product. The amount of axial force and partial rotation needed to achieve this result will vary with the viscosity of the product but in any event is carried out to an extent short of extruding product between the piston flange 20 and the adjacent container-wall surface; the requisite force is readily identifiable for a given product and piston, due to the fact that relatively little axial force is required to assure the void-free relation, while a relatively elevated force is needed to obtain product extrusion between the piston flange and the container wall.

While the invention has been described in detail for preferred and illustrative contexts, it will be understood that modifications may be made without departure from the scope of the invention.

What is claimed is:

1. The method of making a pressurized container for dispensing viscous material, which comprises selecting an open-botton cylindrical container body having a dispensing valve at its closed upper end and inverting the same to upwardly face the open bottom, introducing viscous product into the open end and in intimate void-free contact with container inner-wall surfaces including that of said upper end, selecting a cupped and relatively stiffly closed cylindrical piston body of diameter substantially less than the container-bore diameter and with a flexible peripheral seal flange integrally formed with the body near the stiffly closed end, the flange having a peripherally continuous tubular container-sealing region radially offset from the piston body and of axial extent substantially less than that of the piston body, assembling the selected piston through the open bottom of the container with the closed end of the piston in contact with the viscous product and with the tubular region extending in the direction of the open bottom, imparting a relative rotary displacement of the piston and body with respect to each other after initial piston contact with the product, closing the open bottom of the container with a bottom closure, and squeezing only the tubular region of the flange into axially extending and circumferentially continuous container wall contact by introducing a super-atmospheric charge of pressurized gas between the bottom closure and the piston, whereby piston-body contact with the container wall is limited to prevention of extreme angular misalignment, and whereby in use of the container (a) maximum product is squeezed ahead of the advancing piston and (b) minimum friction characterizes piston advance.

2. The method of claim 1, in which the step of sealing with pressurized gas is performed soon after the step of piston assembly, whereby sealing is accomplished before product has a chance to seep between the seal flange and the container wall.

3. The method of claim 1, in which the flanged piston body is selected for a resilient seal flange outer periphery which has a slight clearance relation with the inner-wall peripheral extent of the container, whereby the piston-insertion step is characterized by self-venting of air between piston and product.

4. The method of making a pressurized container, which comprises selecting a container body having a conically tapering closed upper end wall and open at its lower end, the container body being further selected for a dispensing valve coaxially supported by a yieldable elastomeric bushing assembled to the closed end of the container, the bushing having a conical tapering lower end engaged within and to the conical taper of the container end wall, inverting the container body to upwardly face the open bottom, introducing viscous product into the open end, to substantially fill the container body, selecting a cupped and relatively stiffly closed cylindrical piston body of diameter substantially less than the container-bore diameter and with a circumferentially continuous radially expandible flexible seal portion integrally formed with the body near the stiffly closed end, the seal portion having a peripherally continuous tubular container-sealing region radially offset from the piston body and of axial extent less than that of the piston body, assembling the selected piston through the open bottom of the container with the closed end of the piston in contact with the viscous product and with the piston body facing the open end of the container, said piston assembly step including a rotary displacement of the piston with respect to the container body after initial contact with the product, closing the open bottom of the container with a bottom closure, and sealing the flexible-seal portion to the body using a gas under super-atmospheric pressure; whereby upon product-filling and gas-pressurizing, the lower end of the bushing is pressure-loaded by the product into circumferentially continuous, seal-enhancing relation with adjacent valve and end-wall surfaces, regardless of the extent to which product has or has not been dispensed from the container.

5. The method of claim 4, in which said rotary displacement is a fraction of one revolution.

6. The method of making a pressurized container for dispensing viscous material, which comprises selecting an open-bottom cylindrical container having a dispensing valve at its closed upper end and inverting the same to upwardly face the open bottom, introducing viscous product into the open end and in intimate void-free contact with container inner-wall surfaces, selecting a cupped piston having a central body of maximum cross-sectional extent less than the container-bore diameter and with an integral flexibly expandable tubular seal flange continuously connected at its upper end to the piston body but otherwise radially offset from the piston body, assembling the selected piston with its closed end contacting the product and with rotary displacement to the extent that all air is expelled between the flexible flange and the container wall so that the closed end of the piston has essentially void-free contact with the product, closing and sealing the open bottom of the container with a bottom closure, and introducing a gas under super-atmospheric pressure beneath the piston and against the inner wall of the flexible flange before product enters between the flange and the container wall, whereby the gas expandably pressure-loads the flange into peripherally continuous light sealing contact with the container wall and thus forecloses contact between product and propellant gas.

* * * * *